US005971834A

United States Patent [19]

Murray

[11] Patent Number: 5,971,834

[45] Date of Patent: Oct. 26, 1999

[54] ADJUSTABLE SUPPORT BRA AND METHOD OF MAKING

[76] Inventor: Michael D. Murray, Rte. 11 Box 343, Huntsville, Tex. 77340

[21] Appl. No.: 09/003,193

[22] Filed: Jan. 6, 1998

[51] Int. Cl.[6] ..... A41C 3/00; A41C 3/10

[52] U.S. Cl. ..... 450/68; 450/41

[58] Field of Search ..... 450/41, 60, 61, 450/62, 70, 86, 88

[56] References Cited

U.S. PATENT DOCUMENTS

| | | | |
|---|---|---|---|
| 2,508,903 | 4/1950 | Chaft . | |
| 2,613,356 | 10/1952 | Russell . | |
| 2,731,640 | 1/1956 | Garson . | |
| 2,829,650 | 10/1958 | Guide . | |
| 3,623,487 | 11/1971 | Chiu | 450/86 |
| 5,215,494 | 6/1993 | Flanagan | 450/61 |
| 5,387,150 | 2/1995 | Terrell | 450/41 |
| 5,816,889 | 10/1998 | Fildan | 450/45 |

*Primary Examiner*—Gloria Hale

*Attorney, Agent, or Firm*—Gilbreth - Strozier, P.C.; J.M. (Mark) Gilbreth; Robert W. Strozier

[57] ABSTRACT

The present invention provides an adjustable underwire support bra especially suited for larger breasted women. The bra is designed to allow a wearer to create their own most comfortable fit by independently adjusting inner and outer cup support straps. The bra is also designed with a centerpiece in which to embed the underwire to prevent the underwire from slipping or from poking through the fabric causing discomfort to the wearer and/or fabric wear.

16 Claims, 5 Drawing Sheets

ADJUSTABLE SUPPORT BRA AND METHOD OF MAKING

BACKGROUND OF THE INVENTION

1. Field of the Invention

The present invention relates to clothing and methods of making. In another aspect, the present invention relates to bras and methods of making. In even another aspect, the present invention relates to adjustable bras and methods of making. In yet another aspect, the present invention relates to adjustable underwire support bras and methods of making.

2. Description of the Related Art

Bras are an essential garment for many women. The purpose of a bra is to control excessive movement of the breast which can cause discomfort especially in larger breasted women. Failure of proper support results in the stretching of soft tissue and ligaments of the breast which causes not only general discomfort, but sagging earlier than normal. To provide the necessary support, a bra should not only be properly fitted but also be comfortable to wear.

Many larger breasted women require the additional support provided by an underwire. Problems associated with underwires include fabric wear, caused by the wire rubbing against the fabric, and discomfort caused by the wire poking through the fabric or otherwise chaffing against a wearer's skin. Discomfort is especially problematic for large breasted women where the weight of the breasts cause not only the underwire, but also the straps or hardware to cut into the body. A proper fit ensures better comfort and support.

Obtaining a proper fit, however, is hindered because most bras are massed produced thereby providing a symmetrical garment sized by way of chest circumference and breast or cup size. Such symmetrical construction does not take into account the fact that one's body may not be perfectly symmetrical, the variances in the human body over time or the variances among the bodies of individuals. For example, even when two women have the same chest circumference and cup size, a particular bra will not fit each woman exactly the same. The result is a correctly sized bra that does not fit a particular individual correctly. Therefore, adjustability of a bra is important to compensate for variances in a particular individual's body, in variances of an individual's body due to growth, pregnancy, nursing and/or aging and variances between the bodies of different individuals.

There have been several attempts in the prior art to provide for underwire bras that provide for support for larger breasted women.

U.S. Pat. No. 2,508,903 to Chaft discloses a brassiere having a wire frame designed to support separate and uplift a women's bust.

U.S. Pat. No. 2,613,356 to Russell discloses a brassiere to properly shape and support a women's breasts.

U.S. Pat. No. 2,713,640 to Garson discloses a wire for brassieres and similar garments with a reference to a means by which the wire is cushioned or encased to protect the wearer from contact with parts of the wire as would likely to cause possible irritation or discomfort.

U.S. Pat. No. 2,829,650 to Guide discloses a wire supporting means for a brassiere which is readily removable.

U.S. Pat. No. 5,215,494 to Flanagan discloses a breast foundation and natural support characterized by its immobility relative to the rib-cage and also by its capacity to permit independent movement of breasts while comfortably supporting same. The support assembly includes inner and outer front panels, the later having seam connection to at least the principal supporting cup and the former bearing and underwire. In a modification for the fuller breast, a double cup is interconnected to the outer front panel. An optional prosthesis pocket is also available, wherein a separate piece of fabric is connected at the top of the foundation in both forms of the invention, the fabric hangs down to form a pocket from above. As the prosthesis is inserted from an open side and held in place by the lower pocket, upper pocket is thus formed.

U.S. Pat. No. 5,387,150 to Terrell discloses an improvement in underwire bra construction wherein the ends of the U-shaped underwire are secured to complementary fastening members affixed to the material of the bra cup and wherein such U-shaped underwire is free to swing up or down relative to said complementary fastening system thereby providing a means to eliminate the puncturing of the bra material by the ends of the U-shaped underwire.

Despite the advances of the prior art there is still a need for a support bra which does not suffer from the disadvantages of the prior art.

There is another need in the art for a more comfortable support bra wherein the bra is adjustable to properly fit an individual wearer.

There is even another need in the art for an adjustable underwire support bra so that a wearer may receive proper support without soreness or chaffing from banding, shoulder straps, hooks or wires.

These and other needs in the art will be come apparent to one of skill in the art upon review of this specification, its claims and drawings.

SUMMARY OF THE INVENTION

It is an object of the present invention to provide a support bra which does not suffer from the disadvantages of the prior art.

It is another object of the present invention to provide more comfortable support bra wherein the bra is adjustable to properly fit an individual wearer.

It is even another object of the present invention to provide an adjustable underwire support bra so that a wearer may receive proper support without soreness or chaffing from banding, shoulder straps, hooks or wires.

These and other objects of the present invention will become apparent to those of skill in the art upon review of this patent specification, claims and drawings.

According to one embodiment of the present invention there is provided a article of clothing having a pair of breast receiving cups which are affixed together where a top portion of at least one of the cups is defined by an adjustable strap. The cups are connected to a body encircling strap and shoulder straps where the should straps form a loop for receiving a wearer's shoulder.

According to another embodiment of the present invention there is provided a method for making the above described article of clothing.

According to even another embodiment of the present invention there is provided a article of clothing having a pair of breast receiving cups which are affixed together where a bottom portion of each cup defined by an underwire. The cups are connected with a centerpiece positioned between the cups where the underwires are connected to the centerpiece. The cups are connected to a body encircling strap and shoulder straps where the should straps form a loop for receiving a wearer's shoulder.

According to still another embodiment of the present invention there is provided a method for making the above described article of clothing.

According to yet another embodiment of the present invention there is provided an article of clothing having a pair of breast receiving cups which are affixed together where a top portion of each cup is defined by a pair of connected adjustable straps and where a bottom portion of each cup defined an underwire. The cups are connected with a centerpiece positioned between the cups where the underwires are connected to the centerpiece. The cups are connected to a body encircling strap and shoulder straps where the should straps form a loop for receiving a wearer's shoulder.

According to still another embodiment of the present invention there is provided a method for making the above described article of clothing.

These and other embodiments of the present invention will become apparent to those of skill in the art upon review of this patent specification, claims and drawings.

DETAILED DESCRIPTION OF THE INVENTION

The present invention provides for an adjustable underwire support bra especially suited for large breasted women. The bra is designed to allow a wearer to create their own most comfortable fit and with a minimum amount of hardware to reduce the potential for irritation or chaffing. The bra is also designed to prevent the underwire from slipping or from poking through the fabric thereby causing fabric wear and further discomfort to the wearer.

Figure 1:
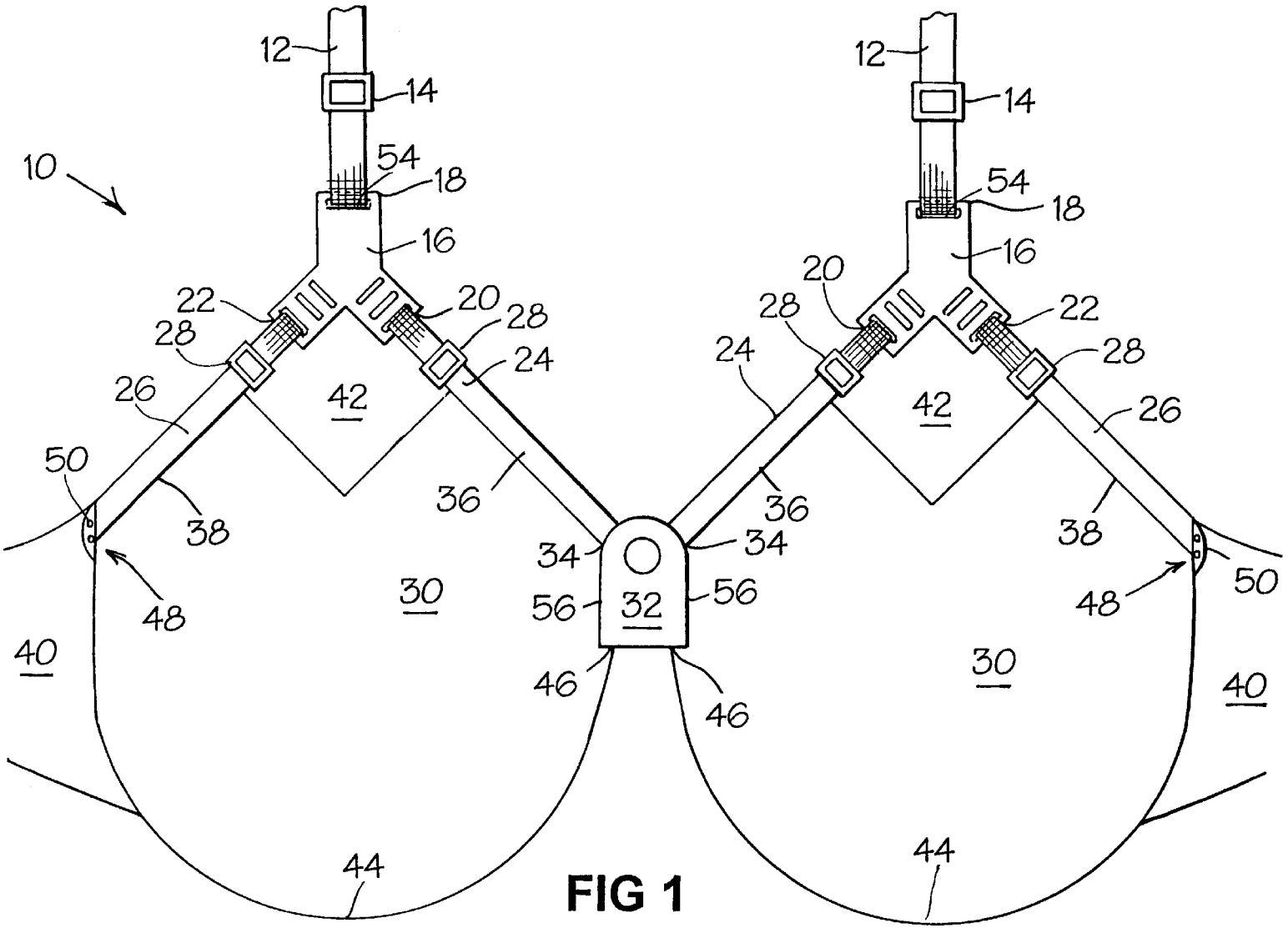
FIG. 1 is a perspective view of one embodiment of the underwire bra 10 of the present invention.
Figure 2:
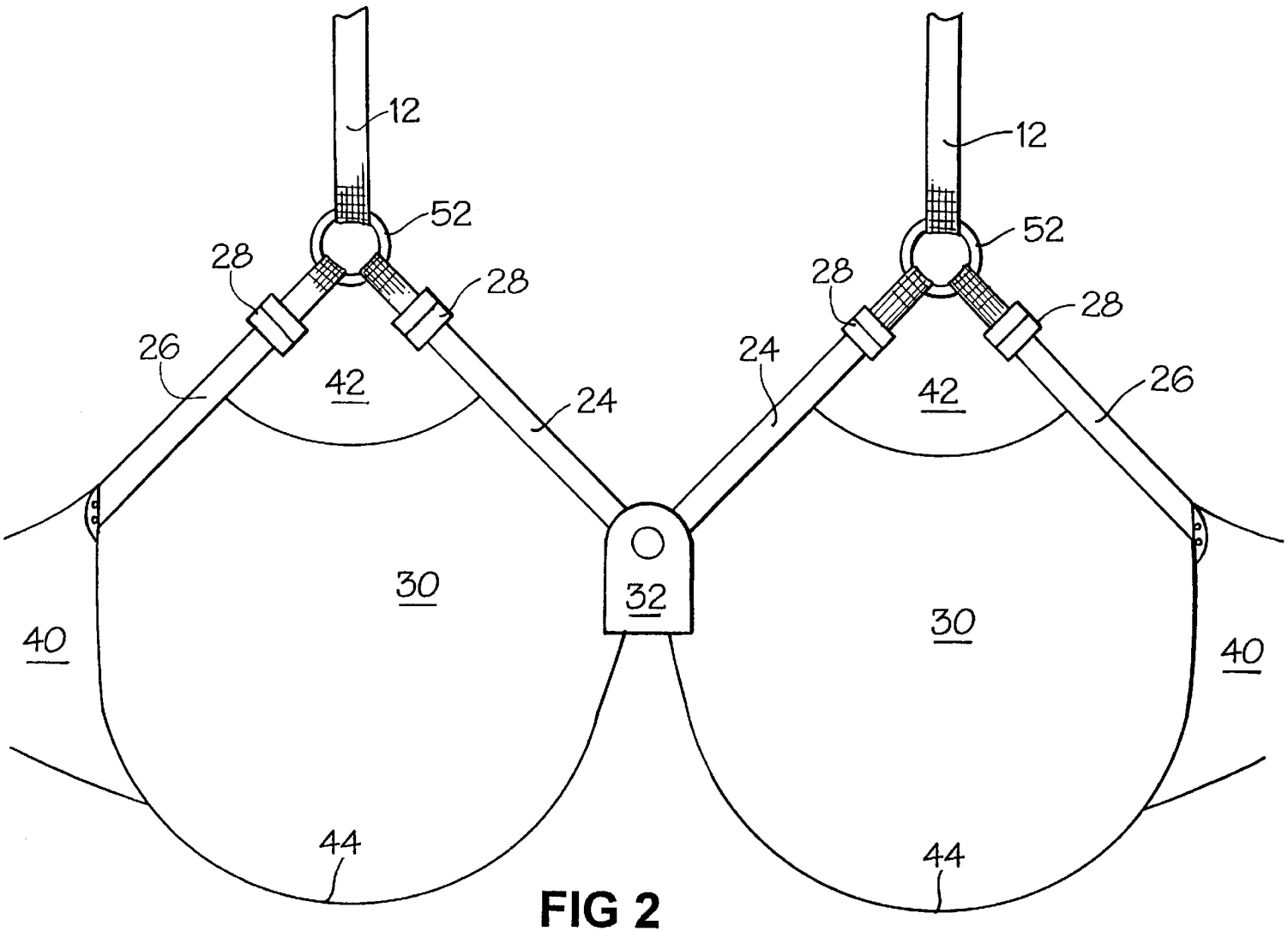
FIG. 2 is a perspective view of a second embodiment of the underwire bra 10 of the present invention.
Figure 3:
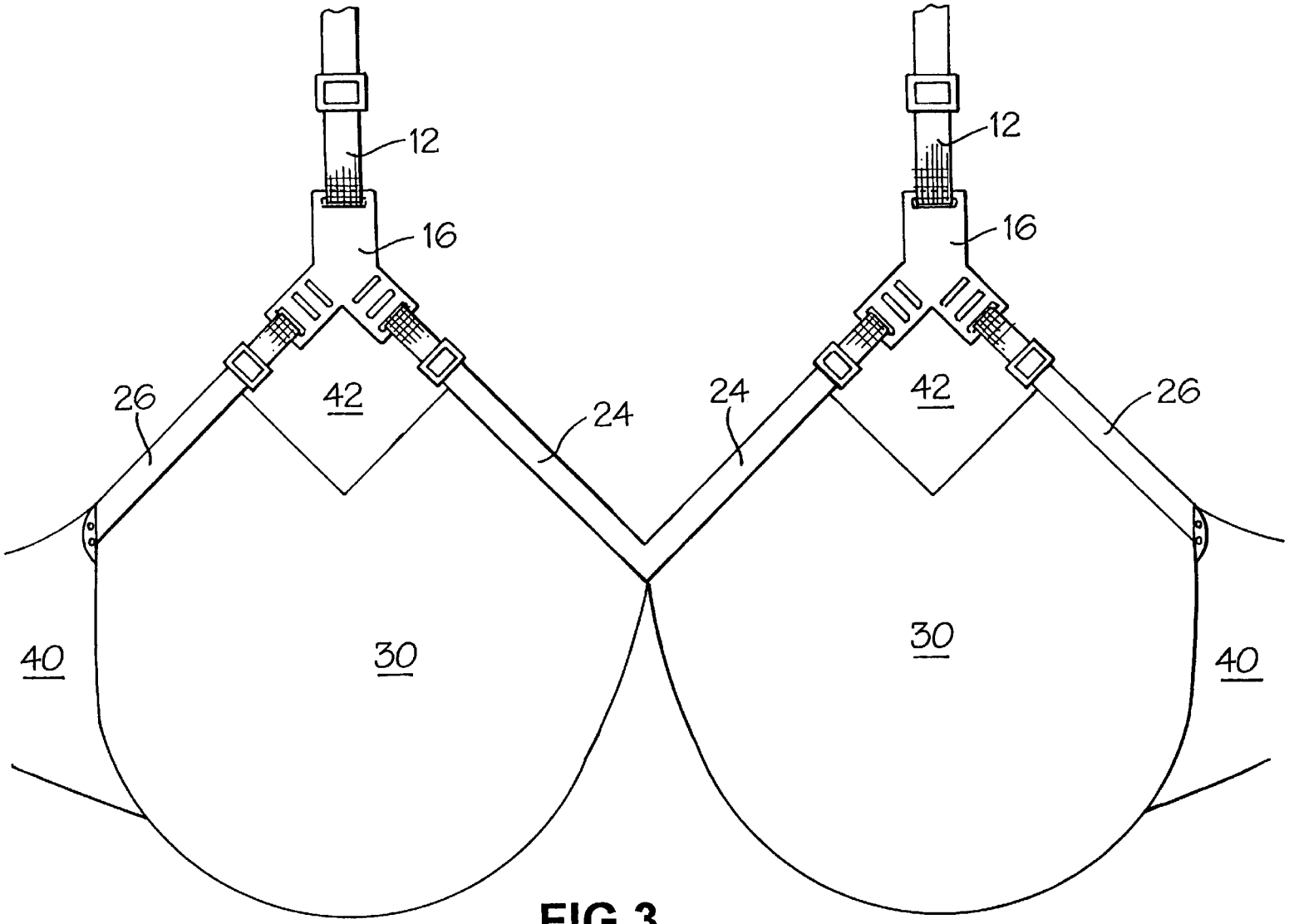
FIG. 3 is a perspective view of a third embodiment of the underwire bra 10 of the present invention.
Figure 4:
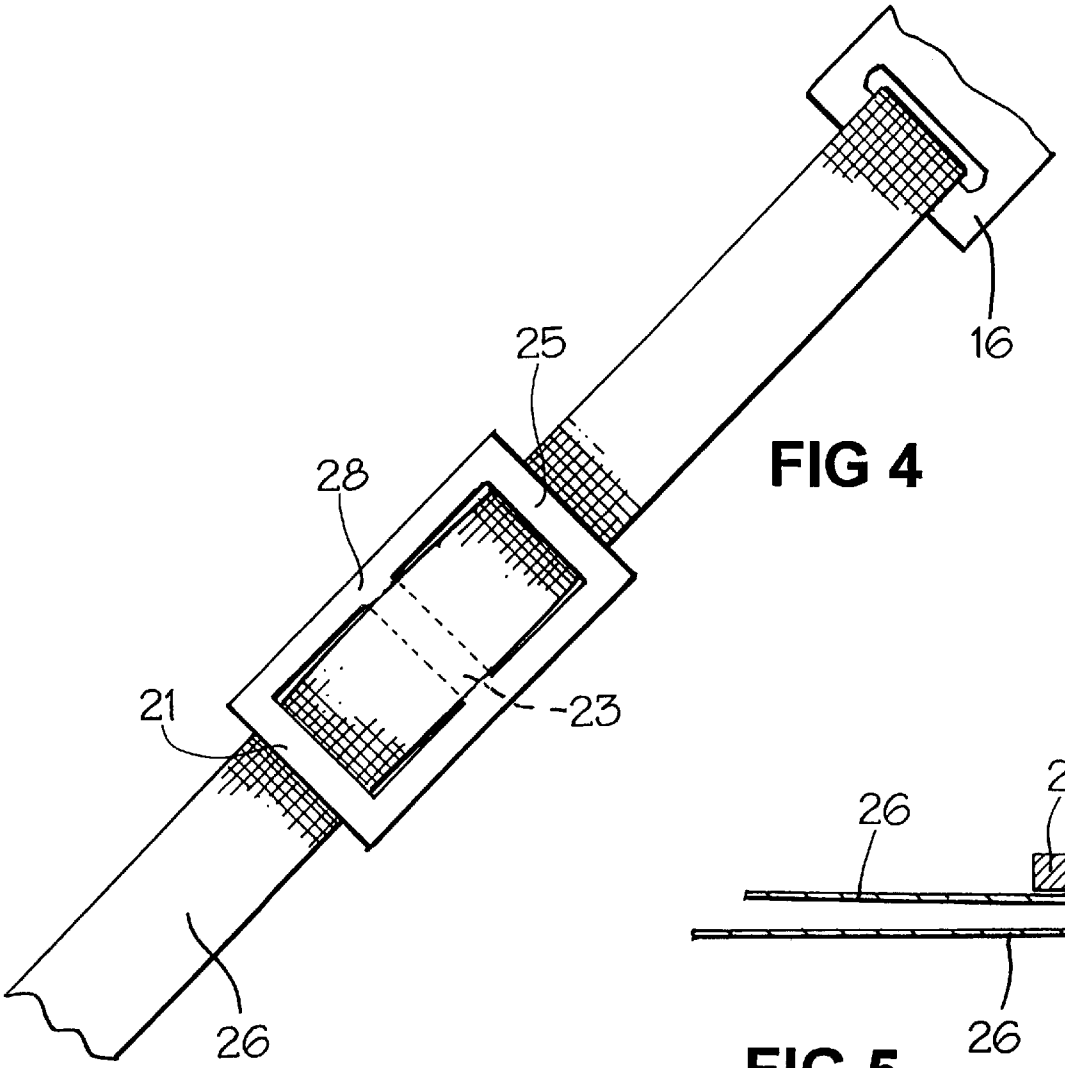
FIG. 4 is a close-up view of adjustment member 28 showing adjuster section members 21, 23 and 25.

Referring now to FIGS. 1, 2 and 3 there are shown embodiments of the bra 10 of the present invention having shoulder straps 12, breast receiving cups 30 and body encircling support straps 40.

In the embodiment shown in FIG. 1, bra 10 includes shoulder straps 12. Shoulder straps 12 are conventional straps adapted to pass over the respective shoulders of the wearer and to provide additional support for the breasts. Straps 12 are made of a fairly inelastic material and in practice any suitable material may be used. Straps 12 must be of a sufficient width to comfortably distribute the weight of the breasts over the shoulders without cutting into a wearer's skin. The length of shoulder straps 12 may be increased or decreased by shoulder strap adjusting members 14 which are incorporated into the straps 12.

One end of shoulder straps 12 are fixedly attached to body encircling support straps 40. Straps 40 are connected to the outer edges of cups 30, and they encircle the body of the wearer and attach to each other by way of any conventional means for securing a bra in place about the body of a wearer. The other end of shoulder straps 12 terminate into strap fasteners 16 having attachment points 18, 20 and 22. In FIG. 1, straps 12 are connected to or otherwise attached to attachment points 18 of fasteners 16 so as to be adjustable. Fasteners 16 may be made of any suitable material, non-limiting examples of which include metals and plastics. Preferably, fastener 16 is made of plastic. Fastener 16 may be of any suitable shape to receive shoulder straps 12. In the non-limiting embodiment shown in FIG. 1, fasteners 16 are an inverted Y shape. Alternately, in another non-limiting embodiment as shown in FIG. 2, fasteners 16 may be replaced with support rings 52.

Inner cup support straps 24 are attached to strap fastener 16 at attachment point 20 and outer cup support straps 26 are attached to strap fastener 16 at attachment point 22. Cup support straps 24 and 26 are made of a fairly inelastic material and in practice any suitable clothing material selected for comfort, fashion, and/or aesthetics may be used.

Cup support straps 24 and 26 are connected to cups 30. Cups 30 may be made of any suitable clothing material generally selected for comfort, fashion and/or aesthetics. Cups 30 may be of any suitable shape to provide coverage and support for the wearer. In FIG. 1, outer cup support straps 26 are fixedly attached to the top outer edge 38 of cup 30. Inner cup support straps 24 are fixedly attached to the top inner edge 36 of cup 30 and terminate into centerpiece 32 at attachment points 34. Inner support straps 24 are sewn into or otherwise securely attached to centerpiece 32. Centerpiece 32 provides permanent attachment between cups 30 at edges 56 where cups 30 are sewn into or otherwise securely attached to centerpiece 32. One benefit of centerpiece 32 is that it provides reinforced and secure attachment between inner cup support straps 24 and cups 30 without additional hardware. The pull on centerpiece 32 by inner support straps 24 allows a tighter fit thereby providing more comfortable support. Centerpiece 32 may be made of any suitable material non-limiting examples of which include metals and plastics. Preferably, centerpiece 32 is made of plastic. Centerpiece 32 may be of any suitable shape to receive and secure inner cup support straps 24 and cups 30. In the embodiments shown in the figures, center piece 32 has a rectangular base and a curved top.

It should be understood that instead of a top portion of each cup 30 being defined by a pair of adjustable straps 24 and 26, that any number of adjustment members 28 may be used. For example, only one set of the straps 26 or 24 could contain an adjustment member 28. Alternately, only one strap could contain an adjustment member.

Referring to FIGS. 4 through 9, The lengths of cup support straps 24 and 26 are independently adjusted by means of cup strap adjustment members 28 incorporated into straps 24 and 26. While only adjustment of support straps 26 is illustrated in FIGS. 4 through 9, it is understood that straps 24 are adjustable in the same manner.

Figure 5:
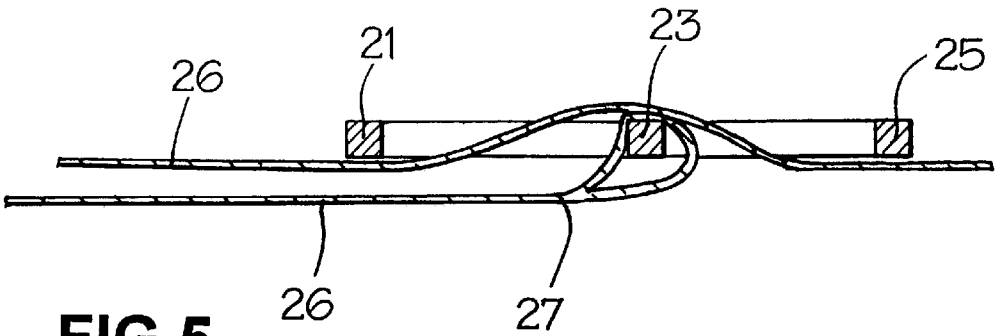
FIG. 5 is a cross sectional view of adjustment member 28 showing strap 26 threaded under adjuster section member 21, over adjuster section member 23 and under adjuster section member 25 with one end of strap 26 fastened around adjuster section member 23.
Figure 7:
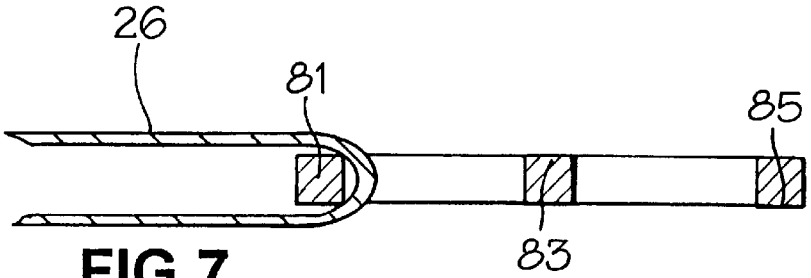
FIG. 7 is a cross-sectional view of fastener 16 showing strap 26 encircling fastener section member 81.
Figure 8:
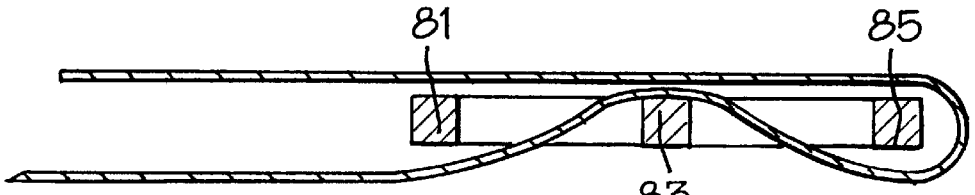
FIG. 8 is a second cross-sectional view of fastener 16 showing strap 26 threaded under fastener section member 81, over fastener section member 83 and encircling fastener section member 85.
Figure 9:
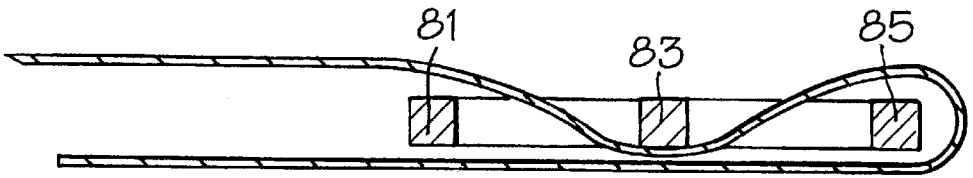
FIG. 9 is a third cross-sectional view of fastener 16 showing strap 26 threaded over fastener section member 81, under fastener section member 83 and encircling fastener section member 85.
Figure 6:
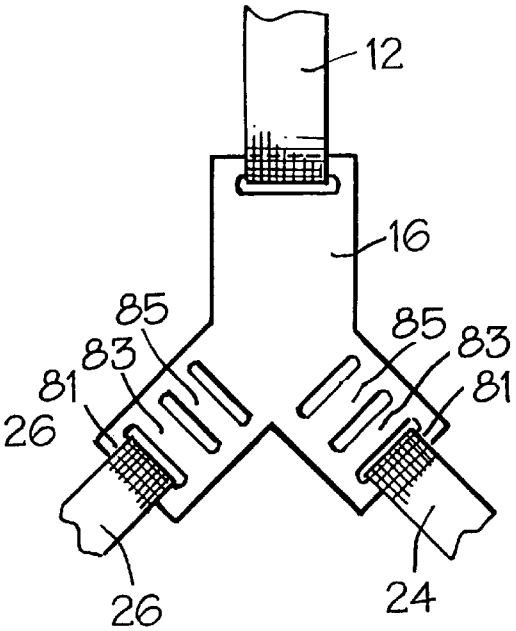
FIG. 6 is a close-up view of fastener 16 showing fastener section members 81, 83 and 85.

The strap adjustment members are incorporated into straps 24 and 26. Referring to FIG. 5 for example, one end of strap 26 is affixed to or stitched around adjuster section member 23 at point 27. Strap 26 then travels to fastener 16 where it is looped around fastener section member 81 as shown in FIG. 7. Alternately, strap 26 can be threaded under fastener section member 81, over fastener section member 83 and encircling fastener section member 85 of fastener 16, as shown in FIG. 8, or strap 26 can threaded over fastener section member 81, under fastener section member 83 and encircling fastener section member 85 of fastener 16 as shown in FIG. 9. To continue the example, Strap 26 then travels back to fastener 28 where, referring back to FIG. 5, it is looped under fastener adjuster member 21, over fastener adjuster member 23 and under adjuster member 25. Strap 26 then terminates in centerpiece 32 as described above. To adjust straps 24 and 26, adjustment member 28 is positioned up or down the respective strap by feeding the strap material through the adjustment member. As described in FIGS. 4–9, straps 24 or 26 are lengthened by positioning adjustment member 28 closer to fastener 16 and shortened by positioning adjustment member 28 closer to centerpiece 32.

Alternately, as shown in FIG. 3, bra 10 of the present invention can be constructed without centerpiece 32 with inner cup support straps 24 being joined together between the breast.

Open areas 42 are defined by outer cup support straps 26, inner cup support straps 24 and cups 30. Open areas 42 allow for straps 24 and 26 to be adjusted by means of cup strap adjustment members 28 without bunching of the fabric of cup 30. Open areas 42 may be of any shape suitable to allow for adjustable movement of adjustment members 28 so as to provide for the individual adjustment of straps 24 and 26. The shape of open areas 42 are generally selected for fashion and other aesthetics. In FIG. 1, for example, the portion of cup 30 defining open area 42 is V shaped. Alternately, as shown in FIG. 2 and FIG. 3 the portion of cup 30 defining open area 42 is curved.

Centerpiece 16 or support rings 52 enables shoulder straps 12, inner cup support straps 24 and outer cup support straps 26 to be adjustable independently by adjustment members 14 and 28 respectively. Since the lengths of both shoulder straps 12 and of all four cup support straps 24 and 26 are independently adjustable, a wearer may create their own individual fit. The wearer can independently adjust the amount of support on either side of the breast by losing or tightening the support straps 24 and 26 to account for variances or asymmetries in the individuals body.

Wire support members 44, which partially encompass a lower portion of cup 30, may be inserted in the fabric of cups 30 by any conventional means such as threaded through channels created by or sewn into the fabric along the bottom edge of cup 30. Ends 46 of wire members 44 terminate at centerpiece 32. Wire members 44 may be inserted into pre-drilled holes, or otherwise attached or incorporated into centerpiece 32. Alternatively, wire members 44 and centerpiece may be integral. Embedding ends 46 into centerpiece 32 shields the ends 46 from the irritating or chaffing against the wearer and from wearing or poking through the fabric of the garment. Ends 48 of wire members 44 may be flattened in a manner to avoid sharp edges and may include holes 50 so that ends 48 may be sewn into the fabric of the garment to secure wire members 44. For example, ends 48 may be sewn into the fabric of cup 30, of outer cup strap 26 and/or of body encircling strap 40. Flatting and curving ends 48 and sewing them into the fabric thereby preventing ends 48 from irritating or chaffing the wearer and from tearing or otherwise poking through the fabric.

While the present invention has been described with each cup 30 having adjustable cup support straps 24 and 26, it must be understood that the top portion of each cup 30 may be defined by one adjustable strap, or even by more than two adjustable straps.

Furthermore, while the top portions of each cup 30 are shown as being independently adjustable, one or more adjustable straps may be utilized to define the top portion of cups 30 so that they are dependently adjustable. As a non-limiting example, one adjustable strap might be utilized to define the top portion of both cups 30.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled the art to which this invention pertains.

I claim:

1. An article of clothing comprising:

(a) a pair of breast receiving cups affixed together where a top portion of at least one cup is defined by at least two adjustable straps having a first end, a second end and a middle portion between the first and second ends, where the first end is attached to the top portion of the cup, the second end is attached to a strap fastener, and a strap adjustment member is adjustably affixed at the middle portion;

(b) a body encircling strap having a first end connected to the first breast receiving cup and a second end connected to the second breast receiving cup and forming a loop for receiving a wearer's body; and (c) a first and second shoulder strap each with a first end connected respectively to said first and second cups and each with a second end connected to a body encircling strap, wherein each shoulder strap forms a loop for receiving a wearer's shoulder.

2. The article of claim 1 wherein the top portion of each breast receiving cup is defined by at least one adjustable strap.

3. The article of claim 1 wherein the top portion of each breast receiving cup is defined by a pair of connected adjustable straps.

4. The article of claim 3 wherein the pair of connected adjustable straps define an open area above each cup.

5. The article of claim 3 wherein the pair of connected adjustable straps are connected by a fastener to the shoulder strap.

6. The article of claim 5 wherein the fastener is an inverted Y shape.

7. An article of clothing comprising:

(a) a pair of breast receiving cups affixed together where a bottom portion of each cup defined by an underwire each having a first end and a second end;

(b) a centerpiece positioned between and connecting the cups; and (c) a first and second shoulder strap each with a first end connected respectively to said first and second cups and each with a second end connected to a body encircling strap, wherein each shoulder strap forms a loop for receiving a wearer's shoulder;

wherein the first end of the underwire is flattened with at least one precut hole; and wherein the second end of each of the underwires is connected to the centerpiece.

8. The article of claim 7 where the centerpiece includes pre-drilled holes to receive the second end of the underwire.

9. An article of clothing comprising:

(a) a pair of breast receiving cups affixed together where a top portion of each cup is defined by a pair of connected adjustable straps and where a bottom portion of each cup defined an underwire each having a first end and a second end;

(b) a centerpiece positioned between and connecting the cups; and (c) a first and second shoulder strap each with a first end connected respectively to said first and second cups and each with a second end connected to a body encircling strap, wherein each shoulder strap forms a loop for receiving a wearer's shoulder;

wherein the first end of the underwire is flattened with at least one precut hole; and wherein the second end of each of the underwires is connected to the centerpiece.

10. The article of claim 9 wherein the pair of connected adjustable straps define an open area above each cup.

11. The article of claim 9 wherein the pair of connected adjustable straps are connected by a fastener to the shoulder strap.

12. The article of claim 11 wherein the fastener is an inverted Y shape.

13. The article of claim 9 where the centerpiece includes pre-drilled holes to receive the second end of the underwire.

14. A method of making an article of clothing comprising:

(a) affixing a pair of breast receiving cups together where a top portion of at least one cup is defined by at least two adjustable straps having a first end, a second end and a middle portion between the first and second ends, where the first end is attached to the top portion of the cup, the second end is attached to a strap fastener, and a strap adjustment member is adjustably affixed at the middle portion;

(b) connecting a body encircling strap having a first end connected to the first breast receiving cup and a second end connected to the second breast receiving cup and forming a loop for receiving a wearer's body; and (c) connecting a first and second shoulder strap each with a first end connected respectively to said first and second cups and each with a second end connected to a body encircling strap, wherein each shoulder strap forms a loop for receiving a wearer's shoulder.

15. A method of making an article of clothing comprising:

(a) affixing a pair of breast receiving cups together where a bottom portion of each cup defined by an underwire each having a first end and a second end;

(b) connecting the cups with a centerpeice positioned between the cups; and (c) connecting a first and second shoulder strap each with a first end connected respectively to said first and second cups and each with a second end connected to a body encircling strap, wherein each shoulder strap forms a loop for receiving a wearer's shoulder;

wherein the first end of the underwire is flattened with at least one precut hole; and wherein the second end of each of the underwires is connected to the centerpiece.

16. A method of making an article of clothing comprising:

(a) affixing a pair of breast receiving cups together where a top portion of each cup is defined by a pair of connected adjustable straps and where a bottom portion of each cup defined an underwire each having a first end and a second end;

(b) connecting the cups with a centerpeice positioned between the cups; and (c) connecting a first and second shoulder strap each with a first end connected respectively to said first and second cups and each with a second end connected to a body encircling strap, wherein each shoulder strap forms a loop for receiving a wearer's shoulder;

wherein the first end of the underwire is flattened with at least one precut hole; and wherein the second end of each of the underwires is connected to the centerpiece.

* * * * *